United States Patent [19]

Law

[11] 4,103,460

[45] Aug. 1, 1978

[54] GRINDER SAFETY DEVICE

[75] Inventor: John P. Law, Athens, Pa.

[73] Assignee: Ingersoll-Rand Company, Woodcliff Lake, N.J.

[21] Appl. No.: 764,724

[22] Filed: Feb. 2, 1977

[51] Int. Cl.[2] ..... B24B 23/00

[52] U.S. Cl. ..... 51/170 R; 51/268; 51/134.5 F

[58] Field of Search ..... 51/170 T, 170 R, 134.5 F, 51/268, 272

[56] References Cited

U.S. PATENT DOCUMENTS

| | | | |
|---|---|---|---|
| 2,149,645 | 3/1939 | Sittert | 51/170 T |
| 2,422,733 | 6/1947 | Jimerson | 51/134.5 F |

*Primary Examiner*—Harold D. Whitehead
*Assistant Examiner*—Roscoe V. Parker
*Attorney, Agent, or Firm*—Walter C. Vliet

[57] ABSTRACT

A safety interlock arrangement for pressure fluid-driven tools wherein positioning of the safety device is required to permit the supply of pressure fluid to operate the tool.

7 Claims, 2 Drawing Figures

GRINDER SAFETY DEVICE

BACKGROUND OF THE INVENTION

Good safety practice has always dictated the use of a guard or protective device for personal safety on certain classes of tools having work engaging members which, because of their high speed of operation or exposed cutting edges, would allow serious injury to the operator should be accidentally contact the working engaging member. In particular, hand-held saws and grinders have long been known to constitute such a hazard, and for this reason saw and grinder manufacturers have provided numerous designs of guards for personal protection. However, a guard is effective only so long as it is used by the operator. In many instances, the inconvenience of the guard no matter how slight has prompted the operator to remove the guard while the tool is in service.

It is the purpose of this invention to minimize or eliminate the possibility of operating pressure fluid-driven tools such as a grinder without having the appropriate guard in place. The purpose of this invention is to provide an inexpensive and reliable interlock between the guard device and the tool. It is a further purpose of this invention to render the tool inoperable when the guard is not securely in place. It is a further purpose of this invention to interrupt the supply of pressure fluid whenever the guard is not secured to the tool. It is still a further purpose of this invention to render the tool incapable of being pressurized so long as the guard is not in place. These and other objects are accomplished by a pressure fluid-driven tool comprising: A tool housing; a pressure fluid supply connected to the housing; a pressure-fluid driven motor means in the housing communicating with the pressure fluid supply and having its work output on a spindle; a work engaging means mounted on the spindle; a guard means attached to the housing for at least partially surrounding the work means; and the attachment of the guard means being essential to the maintenance of the pressure fluid supply.

BRIEF DESCRIPTION OF THE INVENTION

DESCRIPTION OF THE PREFERRED EMBODIMENT

Figure 1:
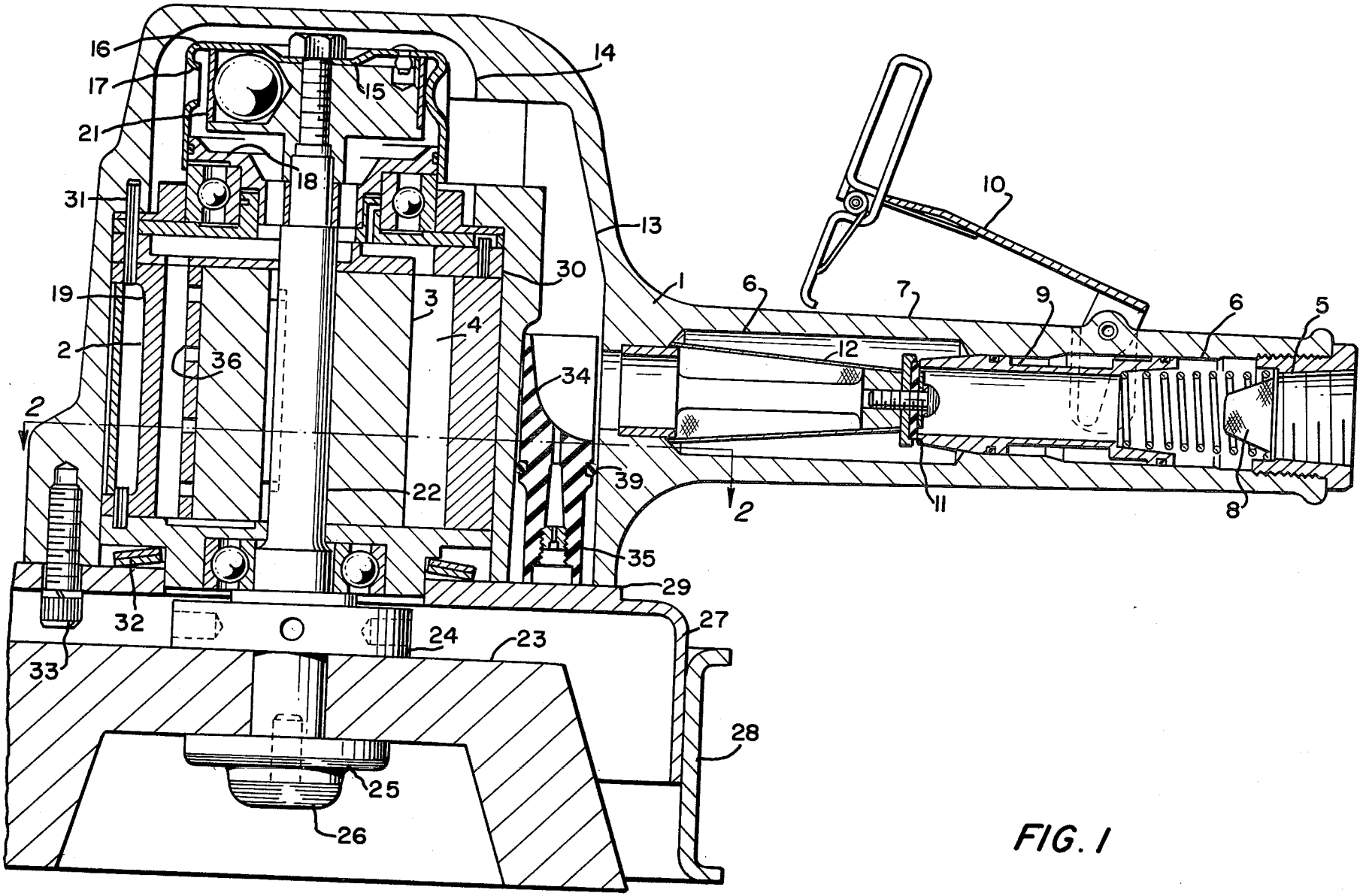
FIG. 1 is a sectional view of the side elevation of the pressure driven tool according to this invention.

Referring now to FIG. 1, a vertical hand-held grinder similar to the type commonly employed in industry for operation by compressed air or the like is shown. The grinder consists of a housing generally designated by numeral 1. The housing contains a pneumatic motor 2 of the typical vane type. The motor rotor 3 and vanes 4 are best seen on FIG. 2. Compressed air enters the housing via pressure fluid inlet 5 and proceeds to the motor by passing through a supply passage 6 in the handle 7 which is attached to the housing.

The pressure fluid first passes through a first screen 3 to where it encounters valve 9. The valve 9 is the primary shut off means for the grinder and may be of any convenient design. An axially displaced end faced spool valve has been chosen for the preferred embodiment. Operation of safety lever 10 will displace the spool to the left as shown in FIG. 1 allowing it to come off of valve seat 11 which then permits the pressure fluid to proceed along the supply passage 6. A second screen 12 has been optionally provided beyond the valve seat. Pressure fluid passing through screen 12 next enters the vertical housing passageway 13 in housing 1. The pressure fluid is here directed to the top of the housing wherein it enters a governor chamber 14. Mounted in the governor chamber for rotation with the motor rotor is centrifugal governor 15.

So long as the grinder is operating below its governed speed, pressure fluid will enter the governor casing 16 through orifice 17 and by means of governor passageway 18 enter the motor housing 19, wherein it will be expanded against the motor vanes 4 to produce the rotary driving force necessary to operate the tool. Whenever the motor exceeds the governed speed, centrifugal force will force the orifice sealing means 21 of the centrifugal governor 15 to close off the orifice 17 thereby reducing the pressure fluid supply to the pneumatic motor 2. This, of course, results in the reduction of power output of the motor and hence its speed will decrease. The work output of the motor 2 is on spindle 22 which has mounted on it a cup grinding wheel 23. Cup grinding wheel 23 is held in place by means of backup washer 24, force washer 25, and machine screw 26 in a well-known manner.

Surrounding the cup wheel is adjustable guard 27 which is provided with an outer adjustable flange 28 to compensate for wheel wear in a conventional manner. The adjustable guard is also provided with a retaining flange section 29 which accomplishes the objects of the invention in cooperation with the following design features. Inspection of FIG. 1 will show the pneumatic motor 2 to be slidingly disposed in the housing 1 in bore 30. Rotation of the pneumatic motor within bore 30 is prevented by locating pin 31. However, the axial retention of the motor is accomplished by means of retaining flange 29. Differences in expansion and makeup tolerances are compensated for by means of dual Belleville springs 32.

Figure 2:
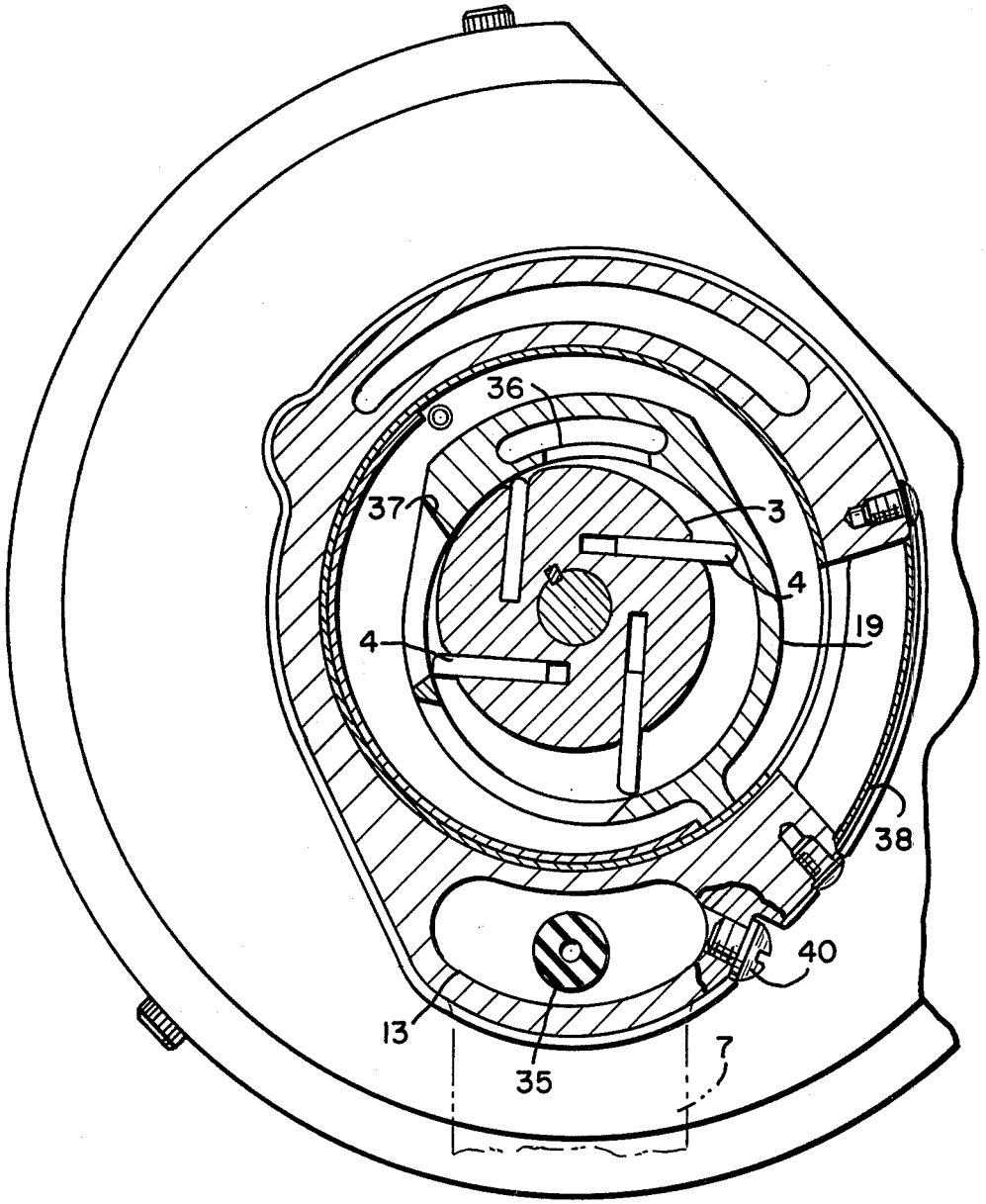
FIG. 2 is a plan section taken through section B-B of FIG. 1.

FIG. 2 is a plan view of the grinder through section B—B of FIG. 1. The section shows the motor rotor 3, the vanes 4, and the motor housing 19 of the pneumatic motor 2. Pressure fluid enters the motor via inlet port 36 and is exhausted to atmosphere through exhaust port 37 around the outside of the motor housing 19, and finally through muffler 38. At the level of section B—B taken through an oiler 34, the cross section of the vertical housing passageway has been elongated to the kidney-shape shown to provide for additional oil capacity. The section of the passageway is circular above and at least to the O ring seal 39. Threaded plug 40 permits filling of the oil cavity.

Adjustable guard 27 and retaining flange 29 are permanently secured together by any well-known bonding process, or alternately retaining flange section 29 may be one piece construction with adjustable guard 27. The guard is held in place by means of several mounting screws 33 which are distributed on the face of the housing and are sufficiently sized and located to restrain the pressure force developed on the motor housing which tends to force it out of the bore 30.

In addition to the placement of the guard being required for motor retention within the grinder housing, vertical housing passageway 13 also communicates with retaining flange section 29. In the case of the preferred embodiment shown, an oiler 34 has been slidingly disposed in the vertical housing passageway 13. The oil retaining cavity 35 surrounding the oiler is utilized for oil storage to lubricate the grinder during operation. The placement of the retaining flange section is required to retain the oiler in the vertical housing passageway 13. The oiler is, of course, an optional item and where it is omitted, vertical housing passageway would communicate directly to atmosphere were the grinder guard to be omitted.

It thus may be appreciated by one skilled in the art that positioning of the grinder guard is required for the operation of the grinder, or one of the three things will prevent the grinder from functioning. Either the motor will be expelled from bore 30 along with the governor, or the oiler will be expelled from the vertical housing passageway 13, or in the event that the oiler is not utilized, the passageway 13 will be directly open to atmosphere. In all events, the grinder will not operate, and the pressure fluid will be vented to the atmosphere. It can thus be appreciated that the unique design of the grinder of my invention will render the grinder inoperable by venting pressure fluid to the atmosphere whenever the safety guard is omitted for any reason.

Numerous other modifications of this invention will occur to one skilled in the art, and I do not wish to be limited in the scope of my invention except by the scope of the following claims.

I claim:

1. A tool guard in combination with a pressure-fluid driven tool comprising:

a tool housing;

a pressure fluid supply connected to said housing;

a pressure-fluid driven motor in said housing communicating with said pressure fluid supply and having its work output on a spindle;

a work engaging means mounted on said spindle;

a guard attached to said housing for at least partially surrounding said work means;

a pressure fluid passage means in said housing communicating with said motor and sealed by said guard; and removal of said guard permits said passage means to communicate with the atmosphere and thereby vent said pressure fluid to atmosphere.

2. The apparatus of claim 1 wherein:

said motor is disposed in said passage means; and removal of said guard permits said motor to freely disassociate itself with said housing and thereby vent said pressure fluid supply to atmosphere.

3. The apparatus of claim 1 wherein:

said pressure fluid passage means includes a separate pressure fluid passage other than to said pressure fluid motor which contains an oiler and removal of said guard permits said oiler to freely disassociate itself with said housing and thereby vent said pressure fluid supply to atmosphere.

4. The apparatus of claim 1 wherein:

said pressure-fluid driven tool is a rotary grinder.

5. The apparatus of claim 1 wherein:

said guard is formed with an integral pressure retaining means.

6. The apparatus of claim 5 wherein:

said integral pressure retaining means is a flange.

7. The apparatus of claim 3 wherein:

said passage means contains both said pressure fluid motor and said oiler.

* * * * *